US007168877B2

(12) United States Patent
Park

(10) Patent No.: US 7,168,877 B2
(45) Date of Patent: Jan. 30, 2007

(54) ADHESIVE APPLICATOR

(76) Inventor: Joon Park, 1320 Virginia Ave., Glendale, CA (US) 91202

( * ) Notice: Subject to any disclaimer, the term of this patent is extended or adjusted under 35 U.S.C. 154(b) by 180 days.

(21) Appl. No.: 10/764,085

(22) Filed: Jan. 23, 2004

(65) Prior Publication Data

US 2004/0149204 A1 Aug. 5, 2004

Related U.S. Application Data

(60) Provisional application No. 60/442,458, filed on Jan. 25, 2003.

(51) Int. Cl.
*B05C 11/00* (2006.01)

(52) U.S. Cl. ..... 401/266; 401/9; 118/254

(58) Field of Classification Search ..... 401/5, 401/9, 48, 193, 266; 118/254, 317, 408, 118/DIG. 10

See application file for complete search history.

(56) References Cited

U.S. PATENT DOCUMENTS 2,694,211 A * 11/1954 Warren ..... 401/264
4,015,830 A * 4/1977 Lodige et al. ..... 366/170.3
5,250,145 A * 10/1993 Despins et al. ..... 156/578
5,256,203 A * 10/1993 Moore et al. ..... 118/698
5,516,224 A * 5/1996 Moshammer ..... 401/266
5,882,133 A * 3/1999 Chao et al. ..... 401/266
6,251,324 B1 * 6/2001 Forte et al. ..... 264/260
6,390,709 B1 * 5/2002 Zerebecki et al. ..... 401/193

* cited by examiner

*Primary Examiner*—Timothy L. Maust
(74) *Attorney, Agent, or Firm*—Christie, Parker & Hale, LLP

(57) ABSTRACT

A brush applicator forms a tapered inner wall and inwardly extended flange inside of a nozzle, which secures either molded or crimped brush assembly. Two edge applicators apply a substantially uniform thin layer of adhesive or glue only on the edge surface of a workpiece. A first edge applicator applies glue through an exit and a second edge applicator has a roller with side flanges and with a reduced portion in-between. A flat surface applicator implements may have plural vanes and channels inside of two outer walls to distribute adhesive to a wider flat exit. A biscuit applicator applies glue on two side surfaces of elliptical slots that are formed by biscuit cutters. The glue flows through plural vanes or plural transversely positioned openings and passes to form two opposite layers of glue. A dowel applicator applies a thin substantially uniform layer of glue on the wall of a dowel-receiving hole prior to installation of dowel pins. The glue is applied using a cylindrical nozzle body with plural projections and a reduced diameter portion. A wet well prevents applicator from clogging by hardened glue. The wet well fits tightly over the cap and the entire inner space of the wet well is saturated with moisture/solvent from a water/solvent retainer.

12 Claims, 5 Drawing Sheets

ADHESIVE APPLICATOR

CROSS REFERENCE TO RELATED APPLICATION

This application claims priority to and the benefit of U.S. Provisional Patent Application No. 60/442,458 entitled "Wood Glue Spreader" filed Jan. 25, 2003, the entire contents of which are incorporated by reference.

FIELD OF THE INVENTION

This invention is related to an adhesive applicator implement, and particularly to a hand-held adhesive or glue spreader that is easy to use, capable of preventing applicator tips from drying, versatile, and that provides a substantially uniform yet precisely controlled glue layer, of which glued areas provide stronger joints.

BACKGROUND OF THE INVENTION

Wooden glue is usually applied onto wood surfaces by using brushes or rollers, or by directly squeezing from the bottle through push-pull closures. Flux is applied by using brushes prior to soldering. Many different types of solvent glue or cement are applied for joining pipes that are made of many different types of material including thermoplastics, which are commonly applied by dipping brushes into a flux, solvent glue, or cement container. These methods not only result in an inconsistent layer of glue, but also require cleaning and removing the excessive dried adhesive or glue from the tools and workpieces.

SUMMARY OF THE INVENTION

This invention relates to adhesive applicators including wood workpieces. For example, it relates to the provision of substantially uniform layer of adhesive or glue on the surfaces that are to be joined.

In an exemplary embodiment according to the present invention, a brush applicator implement for dispensing liquid is provided. The brush applicator implement includes a cap mountable to a bottle and has a tapered nozzle to hold a brush assembly. The brush assembly is secured inside of tapered nozzle and/or inwardly extending flange and has either molded resin ring or crimped sheet metal ring. The molded resin ring or crimped sheet metal ring has a through hole through which various amounts of liquid flow on the workpiece upon squeezing the bottle, wherein horsehair bristles are held by said either molded resin or metal ring.

In another exemplary embodiment according to the present invention, a cap having a check valve for dispensing liquid is provided. Installation of the check valve within a central opening of the nozzle prevents liquid from flowing out freely. Further embodiments may include an interchangeable nozzle that may be mounted on an axial extension from the cap with or without check valve disposed in the cap.

In yet another exemplary embodiment according to the present invention, an edge applicator implement for dispensing a substantially uniform layer of adhesive on the edge of workpiece is provided. The edge applicator implement includes a cap mountable to a bottle. The cap has a nozzle and a detachably mounted guide assembly to dispense adhesive on the edge of workpiece, wherein said nozzle comprises a U-shaped flat end plane that rests on the edge of workpiece to prevent over-spilling of adhesive laterally and a notch for the flow of glue longitudinally, wherein said flat end plane is angled between approximately 15° and approximately 75° from the nozzle, wherein external surface of said nozzle is configured to mount a detachable guide assembly.

In still another exemplary embodiment according to the present invention, a roller applicator implement for dispensing a substantially uniform layer of adhesive on the edge or flat surface of workpiece is provided. This edge applicator implement includes a cap mountable to a bottle. The cap has a roller connected by brackets extending from the cap and one pair of detachably mounted guides, wherein said roller is recessed from two side circular flanges, and adhesive is transferred by movement of roller upon squeezing of the bottle to the edge of workpiece.

In still another exemplary embodiment according to the present invention, a flat surface applicator implement for dispensing a substantially uniform layer of adhesive on the surface of workpiece is provided. The surface applicator implement includes a cap mountable to an adhesive bottle. The cap has a flat but wide nozzle, wherein said nozzle has plural vanes to diverge the flow of adhesive to a wider exit onto the surface of workpiece.

In still another exemplary embodiment according to the present invention, a biscuit applicator implement for dispensing a substantially uniform layer of adhesive on two side surfaces of an elliptical slot is provided. The biscuit applicator implement includes a cap mountable to an adhesive bottle. The cap has two wide walls whose end has an elliptical shape, plural vanes and flow channels between the two walls, plural passes at the end, and plural projections on outside of two walls, wherein glue flows through said channels formed by said vanes and through passes and fills the space defined by projections between the outer walls and each side of elliptical slot walls formed by the biscuit cutter.

In still another exemplary embodiment according to the present invention, a biscuit applicator implement for dispensing a substantially uniform layer of adhesive on two side surfaces of an elliptical slot is provided. The biscuit applicator implement includes a cap mountable to a bottle. The cap has two wide walls whose end is elliptical shape, a pathway between two walls, transversely positioned orifices to the walls and plural projections on outside of two walls, wherein adhesive flows through said orifices and fills the space defined by projections between the outer walls and each side of elliptical slot wall formed by the biscuit cutter.

In still another exemplary embodiment according to the present invention, a dowel applicator implement for dispensing a substantially uniform layer of adhesive on the wall of dowel-receiving hole is provided. The dowel applicator implement includes a cap mountable to a bottle. The cap has a cylindrical nozzle, transversely positioned orifice, two yokes that connect the nozzle and a tip, wherein said tip provides plural projections and circular recesses, wherein adhesive flows through said and onto the dowel-receiving hole wall, wherein the outside surface of said nozzle has hole depth indicia.

In a further exemplary embodiment according to the present invention, a wet well implement for the prevention of applicator tips from clogging by hardened adhesive is provided. The wet well implement includes a body comprising a cup and a water/solvent absorbent, wherein inner circumference of said cup fits tightly over the outer rim of the cap, wherein said water/solvent absorbent is placed on the cup of other end of rim to provide the inner space of the wet well saturated with moisture/solvent.

BRIEF DESCRIPTION OF THE DRAWINGS

These and other aspects of the invention may be described in reference to the following detailed description, taken in conjunction with the accompanying drawings, wherein.

DETAILED DESCRIPTION OF THE EXEMPLARY EMBODIMENTS

The adhesive or glue applicator implement in exemplary embodiments according to the present invention provides for applying adhesive easily with a squeeze of adhesive bottle, resulting in substantially uniformly controlled and substantially even layer of adhesive.

The brush applicator implement may have a brush material such as horsehair bristles molded or crimped inside sheet metal ring that is disposed inside of the nozzle with a central opening, resulting in convenient and continuous use of the brush.

Installation of a check valve disposed within the central opening of the brush assembly prevents liquid from flowing out freely. Another implement may include separable but interchangeable nozzles which may be mounted on an axial extension of the cap.

The edge applicator implements may have edge guides to dispense adhesive only on the edge surface of the workpiece.

The edge applicator and surface applicator implements in exemplary embodiments provide for substantially even and substantially uniform glue layers from a notch at aft and yet contains adhesive by a U-shaped flat end plane.

The surface and biscuit applicator implements may have plural vanes and channels inside of two outer walls to distribute adhesive to a wider exit.

The dowel applicator implement may have a tip to dispense adhesive evenly on the dowel-receiving hole, with projections and recessed circular portions, and may have indicia to measure hole depth prior to dowel insertion.

The wet well implement may have a water/solvent retainer on one end to prevent applicator tip from drying.

Figure 1:
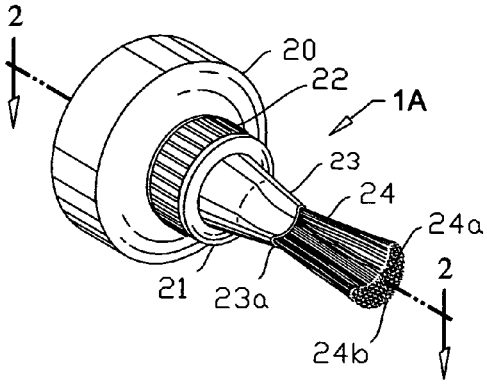
FIG. 1 is a perspective view of a first exemplary embodiment 1A of a brush applicator implement in accordance with the present invention.

A brush applicator implement 1A (or a body thereof) in a first exemplary embodiment according to the present invention is illustrated as a perspective view in FIG. 1 and as cross-sectional views in FIGS. 2A–4. The brush applicator 1A as shown in FIG. 1 is mounted on a bottle 20. A cap 22 of the applicator 1A is provided with a foot in the form of a screw to be screwed onto a threaded connecting stub of the bottle 20. The applicator 1A may include an applicator cap 1B with a molded brush assembly 1C or a crimped brush assembly 1D. The nozzle 23 may have a tapered outer wall whose circumference decreases toward the exit end (−Y axis) and inner walls 25, 25*a* and 25*b* also may be tapered.

Figure 3A:
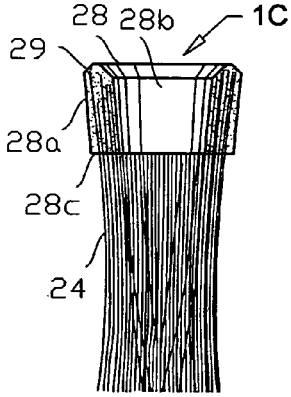
FIG. 3A is an enlarged cross-sectional view from FIG. 2A showing details of a molded brush assembly 1C.
Figure 3B:
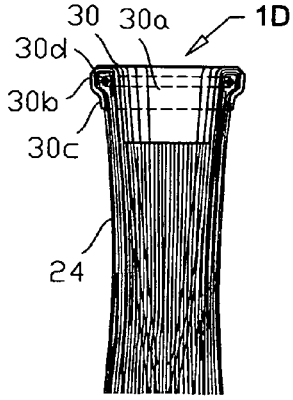
FIG. 3B is an enlarged cross-sectional view from FIG. 2A showing details of a sheet metal crimped brush assembly 1D.

A resin molded ring 28 of molded brush assembly 1C as shown in FIG. 3A may include an outer tapered wall 28*a*, a central opening 28*b*, a chamfer 29 (i.e., a beveled edge) at top and a stepped ring end 28*c*, which may hold horsehair bristles 24 within. Another sheet metal ring 30 of crimped brush assembly 1D as shown in FIG. 3B may include an outer tapered wall 30*b*, a further crimped portion 30*c*, a central opening 30*a*, which hold and secure the horsehair bristles 24 with a brush retaining ring 30*d* within.

The brush assembly 1C or 1D can be either cast or formed prior to insertion into the nozzle 23. The molded assembly 1C may also be cast within tapered inner walls 25 and 25*a*. Once the brush assembly 1C or 1D is placed inside of nozzle 23, it is secured by the shape of tapered inner walls 25 and 25*a*, an inwardly extended flange 26, a secondary inwardly extended flange 26*a* and a step 26*b*, which correspond to the shape of the brush assembly 1C and 1D. By way of example, the nature of taper stops the assembly 1C from downward movement (−Y axis), and the inwardly extended flange 26*a* associated with the chamfer 29 secures the assembly 1C from upward movement (+Y axis) as shown in FIGS. 2A and 4.

The tapered inner walls 25, 25*a* and 25*b* not only provide a liquid passage through the central opening 28*b*, but also provide dense bristle formation at near a nozzle tip 23*a*. With a squeeze of the bottle 20, the glue flows through the central opening 28*b* to the end of the horsehair bristles 24 to dispense proper amount of fluid on the workpiece corresponding to squeeze pressure. Even though the end of lateral cross section of the nozzle tip 23*a* of the body 1A is shown as a crescent, it may be round, rectangular or oval shaped. The crescent shape is useful for applying fluxes or solvents on pipes since the convex 24*b* and concave 24*a* conform to the shape of inner and outer walls of a pipe. The applicator housing 1B may be made of polymer, tin, stainless steel material or any other suitable material.

Figure 2A:
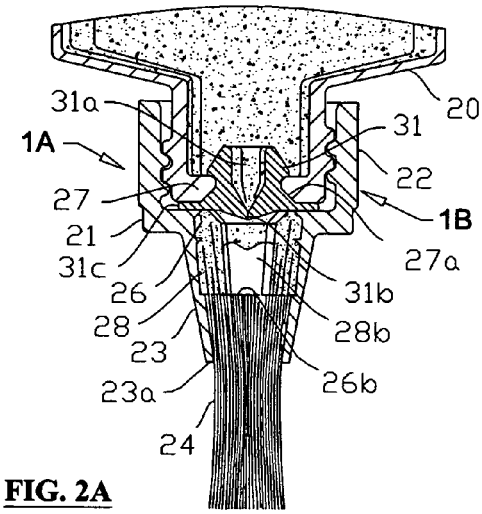
FIG. 2A is a cross-sectional view taken along line 2—2 of FIG. 1.
Figure 4:
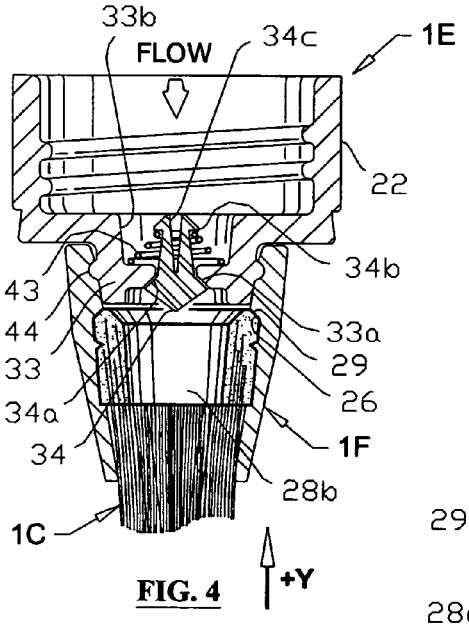
FIG. 4 is an enlarged cross-sectional view showing a modified check valve cap 1E that has a stem installed in an exit hole of a cap and an extension on which a nozzle body is mounted, wherein a brush assembly 1C is mounted in the nozzle body 1F.
Figure 2B:
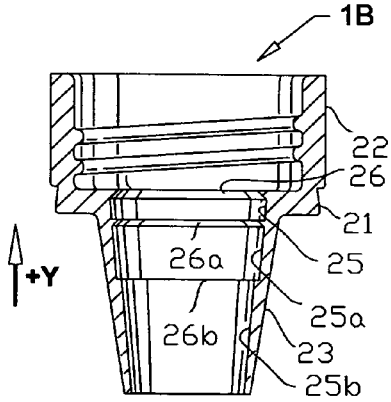
FIG. 2B is an enlarged cross-sectional view from FIG. 2A showing details of a cup 1B.

Check valve can be implemented onto the bottle 20 or onto the cap 22 as illustrated as cross-sectional views in FIGS. 2A and 4. As shown in FIG. 2A, the neck of bottle may form an inwardly extended flange 27 and an exit hole 27*a* on which a valve 31 may be mounted. A check valve 31 made of a flexible elastomer may have an annular recess and two annular extensions on its outer annular wall to fit tightly onto the hole 27. A radially extended valve flange 31C may serve as a gasket between the bottleneck and the cap 22. When the bottle 20 is pressurized, the fluid may flow through a pocket 31*a* and a slit 31*b* to reach to the brush material 24.

As shown in FIG. 4, a check valve cap 1E includes a cap 22 and a nozzle body 1F. The cap 22 may have an axial extension 33 that may include a pocket 33*b* and an exit hole 33*a* on which a stem 34 is disposed to serve as a check valve. A cylindrical shaped stem 34 may include a head 34*a* to sit on the hole 33*a*, a radial flange 34*b* to hold a smaller diameter end of a conical spring 43, and a split 34*c*. The spring 43 keeps the stem 34 close the exit hole 33*a* to prevent the fluid from flowing freely but allows the fluid flow when the bottle is pressurized. The cap 22 may form an annular tongue/groove 44 from which a separate nozzle body IF may be detachably mounted, wherein the brush assembly 1C may be mounted within the body 1F.

The tongue/groove 44 may be replaced by an internal/external thread arrangement. The interchangeability feature of the nozzle body 1F from/on the cap 22 with or without a provision of a simple check valve enables the applicator 1A for many fluid dispensing applications. Application of these brush applicators 1A and 1E with or without a check valve may include dispensing wooden glues, paintings for art/crafts, fluxes for soldering, and primer/solvent-glues for PVC and ABS pipes, for example.

Figure 5:
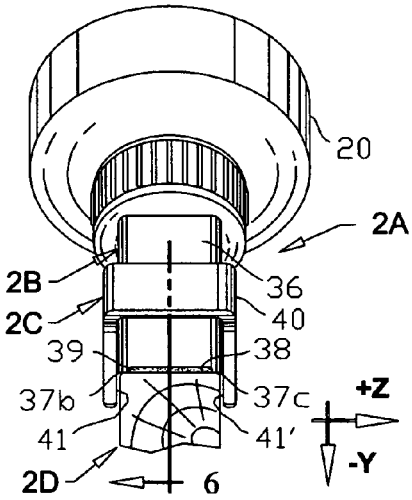
FIG. 5 is a front view of a second exemplary embodiment 2A of a first edge applicator implement with a guide assembly 2C showing the adhesive applied only on the edge surface of the workpiece.
Figure 6:
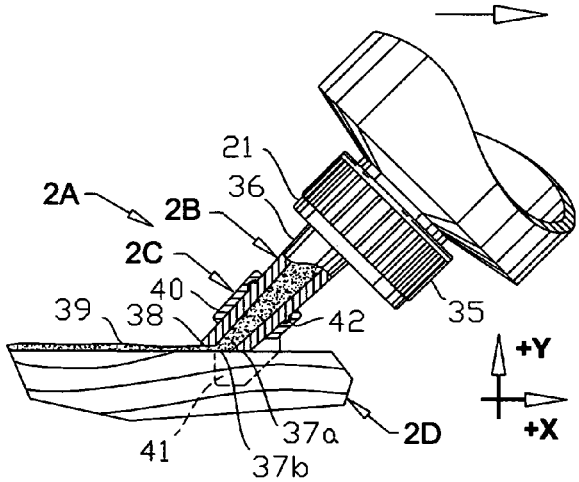
FIG. 6 is a side and partial cross-sectional view taken along line 6 of FIG. 5. The first edge applicator 2A shows that adhesive flows evenly through the nozzle end notch to dispose an even layer of adhesive.

An edge applicator implement 2A (or a body thereof) in a second exemplary embodiment according to the present invention is illustrated as a front view in FIG. 5 and a side and partial cross-sectional view in FIG. 6. The cap 35 of edge applicator 2A as shown in FIGS. 5 and 6 is mounted to a bottle 20. The nozzle 2B may be nose shaped longitudinally, rectangular shaped at its cross section, and extend from the cap 35 to form a U-shaped plane or tip 37 by fore edge 37*a*, with two side edges 37*b* and 37*c* at the other end.

There is an aft notch 38 at an open side of the U-shaped plane 37 where adhesive can flow when the U-shaped flat plane 37 is placed on the surface edge of workpiece 2D. For better visibility, even flow of the adhesive, and/or control of the height of the adhesive thickness, the angle between the axis of the nozzle 36 and the U-shape plane 37 may be set between 15° and 75°. To dispense adhesive only on the edge surface of the workpiece 2D, it is desirable to prevent the nozzle 2B from moving laterally (+/−Z axis in FIG. 5). For example, the height of the aft notch is between approximately 0.025 cm (0.01 inch) and approximately 0.305 cm (0.12 inch) and the lateral width of said notch is between approximately 0.635 cm (0.25 inch) and approximately 6.35 cm (2.50 inches).

A nozzle adapter 40 of a guide assembly 2C may be detachably mounted on the outside of the nozzle 36 and provided with longitudinally extending guides 41 and 41' to slide on side walls of workpiece 2D. Furthermore, a tapered outer wall of the nozzle 36 may be provided with a detent 42 corresponding to the inner wall of adapter 40 for the guide assembly 2C to stay firm when assembled. Therefore, the adhesive flows from bottle 20 as it is being gently squeezed and reaches the U-shaped plane 37 and exits through the aft notch 38 whose shape is generally wide in the horizontal direction (Z axis in FIG. 5) but thin in the vertical direction (Y axis). By moving the edge applicator 2A in the right hand direction (+X axis in FIG. 6) the adhesive exits in a confined lateral direction by one or two guides 41 and 41'. A thin glue layer 39 is applied only on the edge surface without any adhesive spilling on either side (−Y axis in FIG. 5) of the workpiece 2D.

Figure 7:
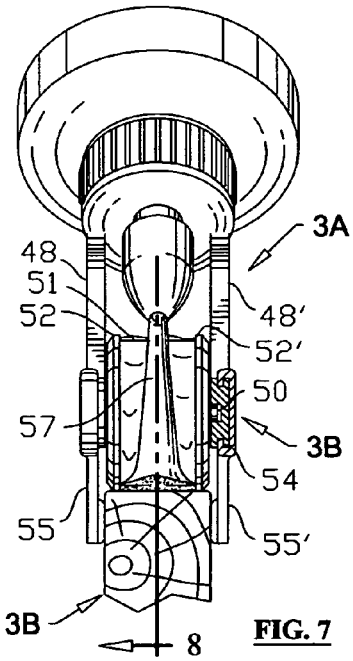
FIG. 7 is a front view of a third exemplary embodiment 3A of a second edge applicator implement with two detachable guides 3B showing the glue dispensed through a roller only onto the edge surface of the workpiece.
Figure 8:
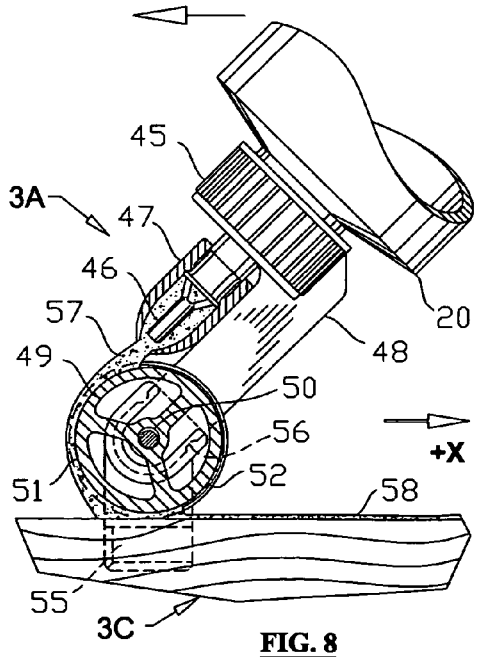
FIG. 8 is a side and partial cross-sectional view taken along line 8 of FIG. 7. The second edge applicator 3A shows that adhesive flows evenly through the roller to dispose an even layer of adhesive.

A roller applicator implement 3A (or a body thereof) in a third exemplary embodiment according to the present invention is illustrated as a front view in FIG. 7 and a side and partial cross-sectional view in FIG. 8. The cap 45 of edge applicator 3A as shown in FIGS. 7 and 8 is mounted to a bottle 20. The cap may have two side brackets 48 and 48' that extend to hold a roller 49 that is held by a shaft 50 at the other end. The roller 49 has two opposing circumferential side flanges 52 and 52' and a circumferential recess 51 in-between. The other end of cap 45 may have a post 46 which can be shut or opened for the glue to flow by sliding a pouring spout 47. Two side guides 55 and 55' may be attached by groove 54 and detents 56 to the side brackets 48 and 48' when they are in use. Glue exits from the end of pouring spout 47 and forms a bead pattern 58. Further movement of the edge applicator 3A in the left hand direction (−X axis in FIG. 8) generates a uniform glue layer 58. The gap between flanges 52 and 52' and the circumferential recess 51 make this uniform glue layer in-between. Therefore, a uniformly thin yet controlled layer of glue 58 is applied only on the edge surface of the workpiece 3C.

The readily detachable feature of the guide assembly 2C from nozzle 2B in FIGS. 5 and 6, and the guide 3B from applicator 3A in FIGS. 7 and 8, enable the edge applicators 2A and 3A to be used for the dispensing of glue on a flat surface or on grooves that are widely used for the wood tongue/grove joints.

Figure 9:
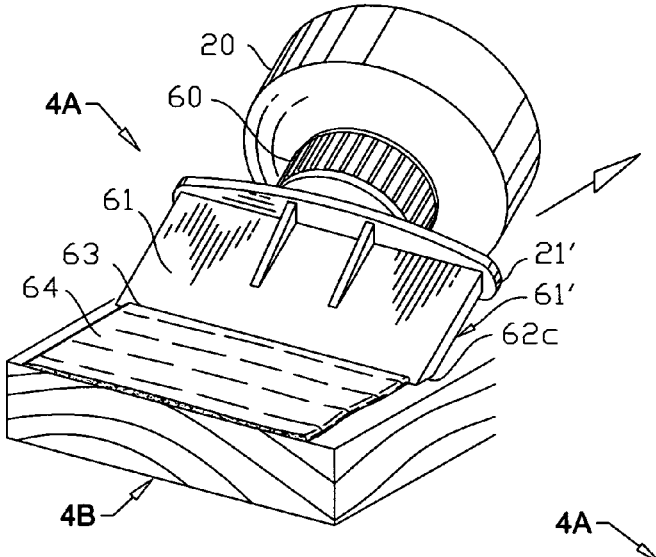
FIG. 9 is a perspective view of a fourth exemplary embodiment 4A of a flat surface applicator implement.
Figure 10:
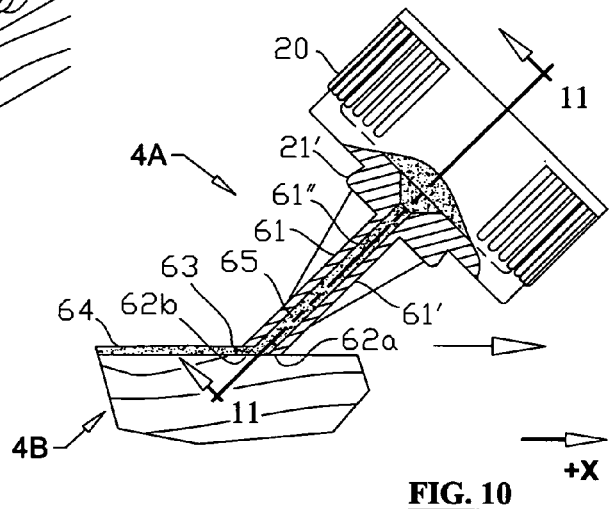
FIG. 10 is a side and partial cross-sectional view of FIG. 9.
Figure 11:
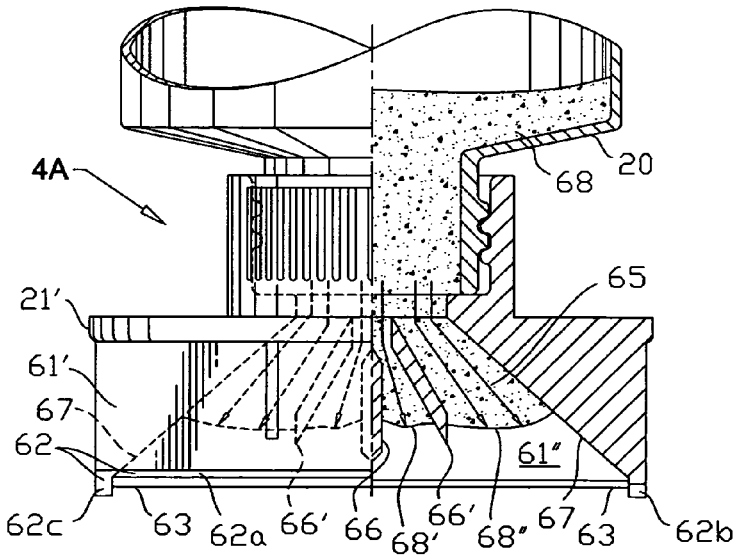
FIG. 11 is a cross-sectional view taken along line 11—11 of FIG. 10.

A flat surface applicator implement 4A (or a body thereof) in a fourth exemplary embodiment according to the present invention is illustrated as a perspective view in FIG. 9, a side and partial cross-sectional view in FIG. 10 and a rear and partial cross-sectional view in FIG. 11. The surface applicator implement 4A may include a cap 60 mountable to a bottle 20; the other end is comprised of an oval rim 21', an aft wall 61, a fore wall 61', a U-shaped plane 62 and a notch 63 through which glue 64 flows onto a surface of workpiece 4B. The U-shaped plane 62 is formed by three edges: fore edge 62*a* and two side edges 62*b* and 62*c*. The flat surface applicator 4A may be generally rectangular shaped and there may be central vane 66, two opposingly positioned vanes 66' and two opposingly located side edges 67, which connect two inner walls 61" to form plural channels 65 as shown in FIG. 11.

The progressive glue flow pattern is shown in FIG. 11; as shown on the right hand side of the figure, the glue 68 flows from the bottle 20 as it is gently squeezed and is diverged by vanes 66 and 66' inside of channel 65 to flow evenly and widely until it reaches near the U-shaped plane 62. The space between the central vane 66 and vane 66' guide divided glue 68', and the guide 66' and diverged wall 67 guide another divided glue 68". There is an aft notch 63 at the end of aft wall 61 and the glue is contained inside of the U-shaped plane 62 where glue can flow out when the U-shaped flat plane 62 is placed on the surface edge of workpiece 4B. The angle between the channel 65 and the U-shaped plane 62 is set between approximately 15° to approximately 75° for better visibility and for even flow of the glue as shown in FIG. 10. By moving the surface applicator 4A in the right hand direction (+X axis in FIG. 10) the glue exits through the notch 63, resulting in a thin glue layer 64 dispensed on the surface of workpiece 4B as shown in FIGS. 9 and 10.

Figure 12:
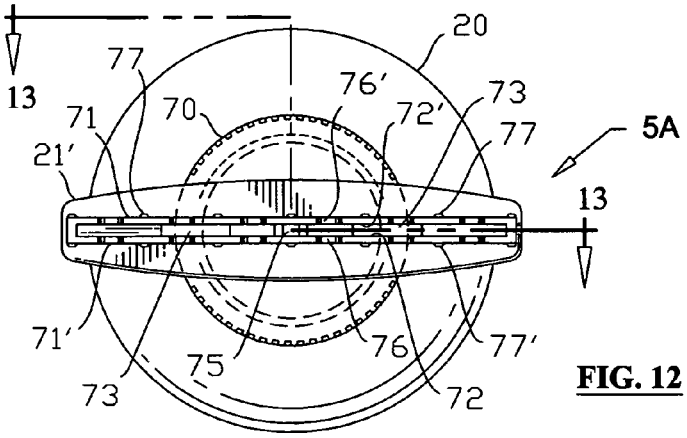
FIG. 12 is a top view of a fifth exemplary embodiment 5A of a first biscuit applicator implement.
Figure 13:
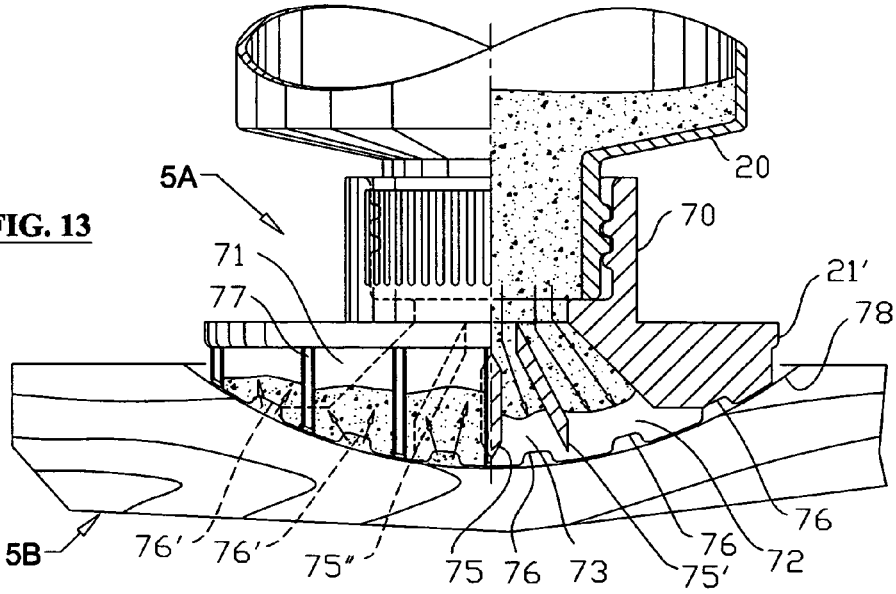
FIG. 13 is a sectional view taken along line 13—13 of FIG. 12.

A biscuit applicator implement 5A (or a body thereof) in a fifth exemplary embodiment according to the present invention is illustrated as a top view in FIG. 12 and a front and partial cross-sectional view in FIG. 13, which may be extended its layouts from the flat surface applicator 4A. The cap 70 of the biscuit applicator 5A as shown in FIGS. 12 and 13 is mounted to a bottle 20 and forms a generally oval shape end corresponding to the elliptical slot 78 cut by biscuit cutters in workpiece 5B. As shown in FIGS. 12 and 13, plural channels 73 are located between two inner sidewalls 72 and 72' that are strengthened/connected by a central vane 75 and two opposingly positioned vanes 75' and 75".

Figure 16:
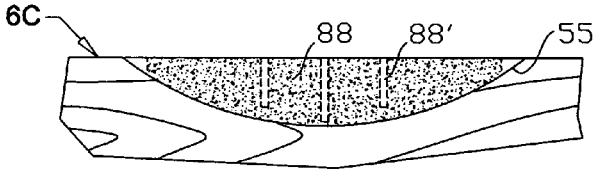
FIG. 16 is a longitudinal sectional view showing an elliptical slot of a workpiece 6*c* after the application of the biscuit applicator 5A or 6A.

The glue flows from the bottle 20 as it is gently squeezed and is directed/distributed by vanes 75 and 75' to flow substantially evenly until reaching near the elliptical slot 78. Further travel of glue flows over plural passes 76' and fills spaces between outer walls 71 and 71' and between plural projections 77 and 77'. The distance between the set of plural opposingly located projections 77 and 77' is slightly narrower than the width of elliptical slot 78. This progressive flow pattern is shown in FIG. 13. The right half of FIG. 13 shows the flow of glue prior to contacting the elliptical slot 78, and the left half shows the flow of glue after flowing over the passes 76'. The glue layer 88 generated onto the workpiece 6C by this applicator 5A is shown in FIG. 16.

Figure 14:
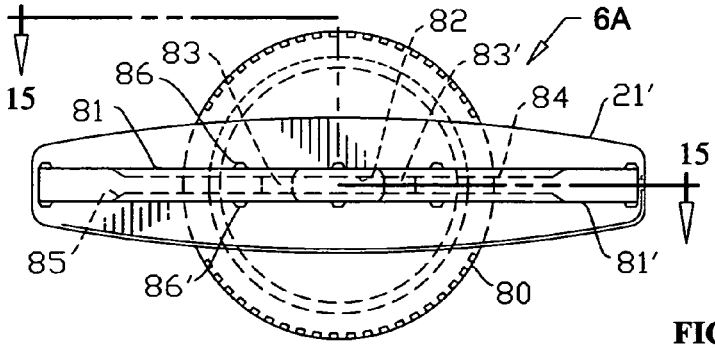
FIG. 14 is a top view of a sixth exemplary embodiment 6A of a second biscuit applicator implement.
Figure 15:
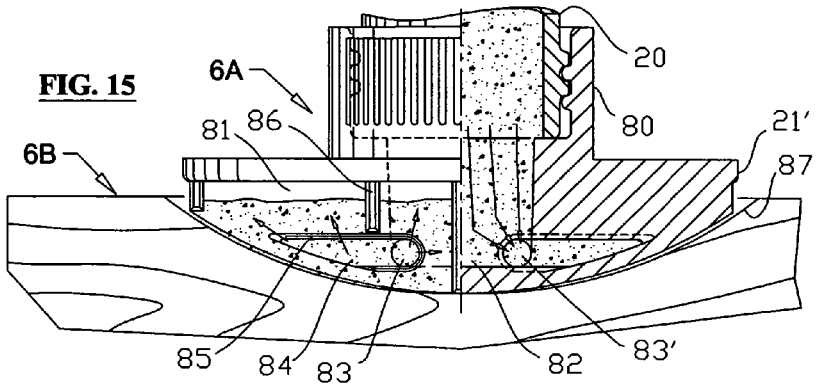
FIG. 15 is a sectional view taken along line 15—15 of FIG. 14.

A biscuit applicator implement 6A (or a body thereof) in a sixth exemplary embodiment according to the present invention is illustrated as a top view in FIG. 14 and a front and partial cross-sectional view in FIG. 15. The cap 80 of the biscuit applicator 6A as shown in FIGS. 14 and 15 is mounted on a bottle 20 and forms a generally oval shaped end corresponding to the elliptical slot 87 cut by biscuit cutters in workpiece 6B. As shown in FIGS. 14 and 15, the glue flows from the bottle 20 as it is gently squeezed into a channel 82, and passes through plural transverse orifices 83' that are at a normal angle to outer wall 81' as shown in the right hand side of FIG. 15. As the glue passes through the plural transverse orifices 83, it fills/spreads two opposingly located slots 84, travels through chamfers 85, then fills two opposite spaces between outer walls 81 and 81', and plural projections 86 and 86'. This progressive flow pattern is shown in FIG. 15; the right half of the figure shows the flow of glue prior to contacting the elliptical slot 87, and the left half shows the flow of glue after flowing over the transverse orifices 83 and slots 84. The glue layer 88 generated onto the workpiece 6C by this applicator 6A is shown in FIG. 16. FIG. 16 is a longitudinal sectional view showing an elliptical slot of a workpiece 6C with glue layer 88 and non-glue lines 88' after using the biscuit applicator 5A or 6A.

Figure 18:
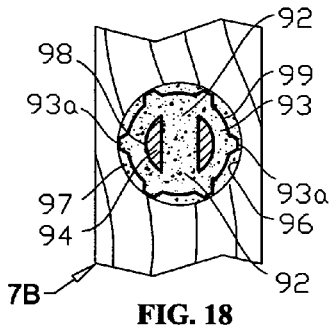
FIG. 18 is a cross-sectional view taken along line 18—18 of FIG. 17.
Figure 17:
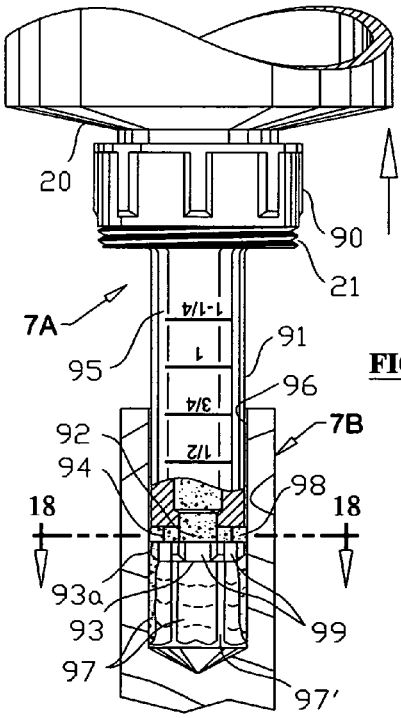
FIG. 17 is a front and partially sectional view of a seventh exemplary embodiment 7A of a dowel applicator implement.

A dowel applicator implement 7A (or a body thereof) in a seventh exemplary embodiment according to the present invention is illustrated as a front view in FIG. 17; FIG. 18 shows a cross-sectional view taken along line 18—18 of FIG. 17. The cap 90 of the dowel applicator 7A as shown in FIG. 17 is mounted to a bottle 20 and may form a cylindrically shaped end corresponding to a round hole wall 96 cut by drill bits in workpiece 7B. The diameter of the cylindrical nozzle 91 and circumference of plural projections 93*a* are sized to fit/slide into the round hole wall 96. The end of body 7A may have two yokes 94 that connect the nozzle 91 and a tip 93. The yokes 94 may be configured to provide two opposing orifices 92 and first recesses 98 circumferentially compared to the circumference of the nozzle 91 to distribute glue evenly over second recesses 99. The tip 93 may have six projections 93*a* that may be of the same diameter as the nozzle 91 and second recesses 99 in between projections 93*a*.

As the bottle 20 is gently squeezed and lifted up, the glue flows through the orifices 92, fills the gap between the wall 96 and the first recesses 98, and travels through plural spaces among the wall 96, the second recesses 99 and projections 93*a*, resulting in plural glue layers 97 and non-glue lines 97'. The non-glue lines 97' will eventually disappear and leave a uniform layer of glue on the round hole wall 96. The outer surface of nozzle body 91 may have plural indicia 95 for the user to check the depth of the hole 96 prior to gluing and dowel insertion.

Figure 19:
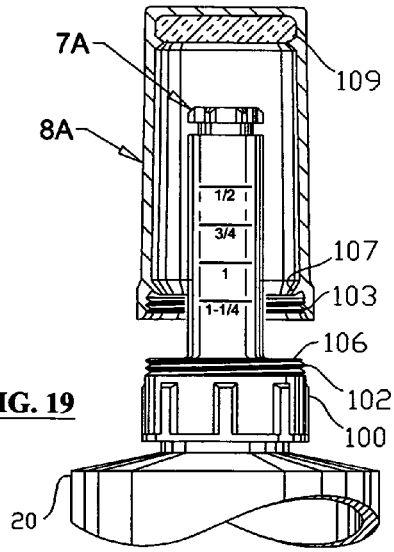
FIG. 19 is a cross sectional view of an eighth exemplary embodiment 8A of a wet well implement showing that the wet well 8A is fitted on to the dowel applicator 7A.

A wet well implement 8A (or a body thereof) in an eighth exemplary embodiment according to the present invention is illustrated as a sectional view in FIG. 19, which is mounted onto the dowel applicator 7A. The body 8A may be generally cup shaped with one end having an opening that fits tightly on the rim of the cap 100 and the other end having affixed a water/solvent retainer 109 such as a sponge or felt material. Often the adhesive applicators are unused for hours without cleaning the nozzles, pathways, channels, tips or brushes; this may result in hardened glue that ruins the applicator. The inner wall of circumferential opening area may be formed with an internal thread 103 in wet well 8A to engage with an external thread 102 formed on the top of cap 100 to provide an air seal, which also may be achieved by a circumferential tongue that replaces the internal thread 103 and a circumferential groove that replaces the external thread 102. Furthermore, when an inwardly/downwardly extended circumference flange lip 107 contacts with the cap top surface 106, it helps to have an airtight seal. The water/solvent retainer 109 with drops of water/solvent provides the inner space of wet well 8A to be saturated with moisture/solvent to prevent from hardening glue or adhesive within the wet well, which houses many different type of applicators. The wet well 8A may be mounted on the circular rim 21 of the applicator 1A and in FIG. 1 and of the edge applicator 2A in FIG. 5. Oval rims 21' located aft the cap 60, 70 and 80 as shown in FIGS. 9 through 15 can also readily accommodate oval shaped cups with a water/solvent retainer in it to achieve the same purpose.

The entire embodiments as shown in FIGS. 1–19 may be constructed by inexpensive thermoplastics, except valve 31 in FIG. 2A, brush assembly 1C in FIG. 3A, 1D in FIG. 3B, and the water/solvent retainer 109 in FIG. 19.

It will be appreciated by those of ordinary skill in the art that the invention can be embodied in other specific forms without departing from the spirit or essential character hereof. The present description is therefore considered in all respects to be illustrative and not restrictive. The scope of the invention is indicated by the appended claims, and all changes that come within the meaning and range of equivalents thereof are intended to be embraced therein.

What is claimed is:

1. An apparatus for applying a layer of fluid onto a workpiece moving relative to the apparatus, for use cooperatively with a fluid container, comprising:

a nozzle for dispensing the fluid, said nozzle comprising a cap to mount onto the fluid container;

an outer wall having a first end which is extended from said cap and a second end, wherein said cap and said nozzle has a fluid passage which defines an axis; and at least two oppositely disposed orifices, said orifices being substantially normal to said axis and connected to a said fluid passage, said orifices being located in-between said first end and said second end of said outer wall, wherein said outer wall has plural projections and recesses, said projections being parallel to said axis, wherein said projections are configured corresponding to a pocket formed in a workpiece and defined by a pocket wall, so as to allow the fluid to flow in-between said recesses and said pocket wall of the workpiece, wherein the layer of fluid is defined by the distance between said pocket wall and said recess.

2. The apparatus as claimed in claim 1, wherein said pocket is selected from a group consisting of a dowel receiving hole and a biscuit receiving elliptical slot.

3. The apparatus as claimed in claim 1, wherein said outer wall is rectangular in shape and has two side walls, two major walls, and an elliptical member which connects said two side walls.

4. The apparatus as claimed in claim 3, further comprising indicia disposed on at least one of the major walls to indicate the distance from a center of said elliptical member.

5. The apparatus as claimed in claim 3, further comprising at least one slot that extends from at least one of said orifices toward said side walls, said slot and the at least one of said orifices being connected to define the fluid passage.

6. The apparatus as claimed in claim 1, wherein said plural projections and recesses are disposed on said second end of said outer wall, and wherein said first end of said outer wall is round in shape which is sized corresponding to a drilled hole so as to prevent the fluid from flowing toward said first end of said outer wall.

7. The apparatus as claimed in claim 6, further comprising indicia disposed on said outer wall to indicate the distance from said second end.

8. The apparatus as claimed in claim 1, further comprising a rim disposed on said cap and substantially parallel to said axis, a cup having an opening which has an interengage relationship with said rim, wherein said cup has a plane opposite to said opening, said cup removably attached on said rim, and a retainer attached onto said plane so as to provide the inner space of said cup saturated with vaporized fluid when said nozzle and said cup are assembled.

9. The apparatus as claimed in claim 8, wherein said interengage relationship uses a locking means, said means include external/internal threads or tongue/groove arrangement on peripheries of said rim and the inner circumference of said opening to attach said cup on said cap.

10. The apparatus as claimed in claim 8, further comprising a downwardly extending circumferential flange formed on inner circumference in said cup, wherein said flange is located toward inner side from said opening as an airtight seal.

11. The apparatus as claimed in claim 8, wherein the material of said retainer is selected from a group consisting of felt and sponge.

12. The apparatus as claimed in claim 8, wherein said rim has a shape selected from the group consisting of oval, round and rectangular shapes.

* * * * *